US011357303B2

(12) United States Patent
Reynolds

(10) Patent No.: US 11,357,303 B2
(45) Date of Patent: Jun. 14, 2022

(54) STATIONERY SECURING APPARATUS AND INSTRUMENT HOLDER

(71) Applicant: Donald James Reynolds, Victoria, MN (US)

(72) Inventor: Donald James Reynolds, Victoria, MN (US)

( * ) Notice: Subject to any disclaimer, the term of this patent is extended or adjusted under 35 U.S.C. 154(b) by 0 days.

(21) Appl. No.: 16/871,666

(22) Filed: May 11, 2020

(65) Prior Publication Data

US 2021/0037941 A1 Feb. 11, 2021

Related U.S. Application Data

(63) Continuation-in-part of application No. 15/910,172, filed on Mar. 2, 2018, now Pat. No. 10,647,149.

(60) Provisional application No. 62/466,639, filed on Mar. 3, 2017.

(51) Int. Cl.

| | |
|---|---|
| ***A45C 11/34*** | (2006.01) |
| ***A45C 13/12*** | (2006.01) |
| ***B42D 3/10*** | (2006.01) |
| ***B42D 3/12*** | (2006.01) |

(52) U.S. Cl.

CPC ..... *A45C 11/34* (2013.01); *A45C 13/123* (2013.01); *B42D 3/10* (2013.01); *B42D 3/12* (2013.01); *B42P 2241/04* (2013.01); *B42P 2241/18* (2013.01)

(58) Field of Classification Search

CPC ..... A45C 11/34; A45C 13/123; A45C 13/30; B42D 3/12; B42D 3/10; B42P 2241/18; B42P 2241/04; B43K 23/001

See application file for complete search history.

(56) References Cited

U.S. PATENT DOCUMENTS

| | | | | |
|---|---|---|---|---|
| 417,942 | A | 12/1889 | Raffel | |
| 433,938 | A | 8/1890 | Gleeson | |
| 738,462 | A | 9/1903 | Lincoln | |
| 1,482,647 | A | 2/1924 | Gise | |
| 1,484,321 | A | 2/1924 | Brouillette et al. | |
| 1,603,044 | A | 10/1926 | Gise | |
| 1,960,690 | A * | 5/1934 | Blair | B42F 1/00 40/665 |
| 2,704,077 | A | 3/1955 | Prillaman | |
| 3,577,604 | A | 5/1971 | Brosk | |
| 3,823,814 | A | 7/1974 | Lum | |
| 4,133,080 | A | 1/1979 | Kuk | |
| 4,162,800 | A | 7/1979 | Gonot, Jr. et al. | |
| 5,016,559 | A | 5/1991 | Larson et al. | |
| 5,154,506 | A | 10/1992 | Leard | |
| 5,446,953 | A | 9/1995 | LeFeber | |
| 5,456,497 | A | 10/1995 | Ross, Jr. | |

(Continued)

FOREIGN PATENT DOCUMENTS

| | | |
|---|---|---|
| CA | 2878532 | 4/2017 |
| CH | 89101 | 4/1921 |

(Continued)

*Primary Examiner* — Robert Sandy

(74) *Attorney, Agent, or Firm* — Vidas, Arrett & Steinkraus, PA; Richard A. Arrett; Edwin E. Voigt, II

(57) ABSTRACT

An elastic band, at least a portion of which is elastic and including a woven slit made in the elastic band to hold an object. The band can also have two woven slits which form an elastic loop which can be used to hold an object, such as a writing implement or other tool.

4 Claims, 23 Drawing Sheets

(56) References Cited

U.S. PATENT DOCUMENTS

| | | | | |
|---|---|---|---|---|
| 5,636,868 | A | 6/1997 | Ross, Jr. | |
| 5,881,434 | A | 3/1999 | Rigney | |
| 6,481,367 | B2 | 11/2002 | McClosky | |
| 7,562,636 | B2 | 7/2009 | Regala | |
| 9,949,555 | B2 * | 4/2018 | Wu | A45F 3/005 |
| 2008/0314773 | A1 | 12/2008 | Dragonheart | |
| 2011/0305496 | A1 | 12/2011 | Jolani | |
| 2013/0049345 | A1 | 2/2013 | Imbernino | |
| 2014/0263496 | A1 | 9/2014 | Zimmerman et al. | |
| 2015/0037081 | A1 | 2/2015 | Sutton | |
| 2017/0030386 | A1 * | 2/2017 | Vecchione | B65H 75/446 |

FOREIGN PATENT DOCUMENTS

| | | | |
|---|---|---|---|
| DE | 20 2016 103 313 | U1 | 11/2016 |
| WO | 2007/023275 | A1 | 3/2007 |

* cited by examiner

STATIONERY SECURING APPARATUS AND INSTRUMENT HOLDER

CROSS-REFERENCE TO RELATED APPLICATIONS

This application claims priority to 62/466,639, filed Mar. 3, 2017 and application Ser. No. 15/910,172, filed Mar. 2, 2018, the entire contents of each of which are hereby incorporated by reference.

STATEMENT REGARDING FEDERALLY SPONSORED RESEARCH

Not Applicable

FIELD OF THE INVENTION

The invention relates to a stationery securing apparatus and writing instrument holder, which can also be wrapped around and attached to itself to hold writing implements.

BACKGROUND OF THE INVENTION

Many different stationery securing device have been invented. See the table below which lists them:

| U.S. Pat. No. | Date | Title |
|---|---|---|
| 0,417,942 | Dec. 24, 1889 | Combined book strap and Scholar's companion |
| 0,433,938 | Aug. 12, 1890 | Pencil Holder |
| 0,738,462 | Sep. 8, 1903 | Combined Book Carrier and Scholar's Companion |
| 1,484,321 | Feb. 19, 1924 | Combined Paper and Pencil Holder |
| 2,704,077 | Sep. 10, 1953 | Pen and Pencil Holder |
| 3,577,604 | May 4, 1971 | Writing Implement Holder for books or Like Articles |
| 3,823,814 | Jul. 16, 1974 | Apparatus for Attaching Objects to each other |
| 4,133,080 | Jan. 9, 1979 | Textbook Holder |
| 4,162,800 | Jul. 31, 1979 | Combination Bookmark and Writing Instrument Holder |
| 5,016,559 | May 21, 1991 | Bookmark Having Integral Pencil Holder |
| 5,446,953 | Sep. 5, 1995 | Elastic Apparatus for Restraining Articles |
| 5,456,497 | Oct. 10, 1995 | Apparatus for Holding Reading Material Binder |
| 5,636,868 | Jun. 10, 1997 | Apparatus for Holding Reading Material Binder |
| 5,881,434 | Mar. 16, 1999 | Implement Holder |
| 6,481,367 | Nov. 19, 2002 | Combination Pen Holder and bookmark/Placesaver |
| 7,562,636 | Jul. 21, 2009 | Writing Instrument Holder and Bookmark |
| US 2008/0314773 | Dec. 25, 2008 | Highlighter Holder to Marketed as "Marker Mate" |
| US 2013/0049345 | Feb. 28, 2013 | Pen or Pencil Holder for Notebook, Planner or Binder Cover Panel |
| US 2014/0263496 | Sep. 18, 2014 | Holder for Writing Instruments |
| WO 2007/023275 | Mar. 1, 2007 | A Holder |
| DE 202016103313 U1 | Nov. 24, 2016 | In German |
| CH 89101 | Apr. 16, 1921 | Not sure - Switzerland |
| CA 02878532 | Dec. 14, 2016 | Book with writing instrument storage space |

BRIEF SUMMARY OF THE INVENTION

What is needed is a stationery holder which can also hold writing implements and also forms a compact portable writing instrument holder. A stationery securing apparatus and writing instrument holder is provided with a band, at least a portion of which is elastic. At least two writing instrument loops are attached to the elastic band, and a male snap portion and a female snap portion attached to the band, configured and arranged so that when the band is not in use securing stationery, it can be folded or rolled up and the male snap portion and the female snap portion can be snapped together to form a compact writing instrument holder.

Stationery securing apparatus and instrument holder used to keep stationery items organized and together; easily attaches and detaches; when not in use as securing apparatus (as in FIG. 1), it easily transforms into a compact portable pen/instrument holder (FIG. 2).

This apparatus is easily customizable, compact, modular and provides unique multiuse features and benefits than any other: bookmark, journal band or pen holder available today.

The methods used to fold or roll apparatus and then secure it to itself transforming it from a robust journal band to a compact portable pen holder are unique to this invention. Various lengths, widths, materials and techniques may be used in its construction; it is the combinations of compact, multipurpose, ease of modular attachability and prominent display locations that are unique to this invention.

Modular attachments may include but are not limited to: name labels, brands, icons, logos, additional organizational tools (such as pockets) and/or miscellaneous decorative embellishments.

BRIEF DESCRIPTION OF THE DRAWINGS

FIG. 32 shows a clear plastic case the inventive journal band can be packaged in or shipped in.

FIG. 44 shows the button hole the button is fastened to.

DETAILED DESCRIPTION OF THE INVENTION

Figure 1B:
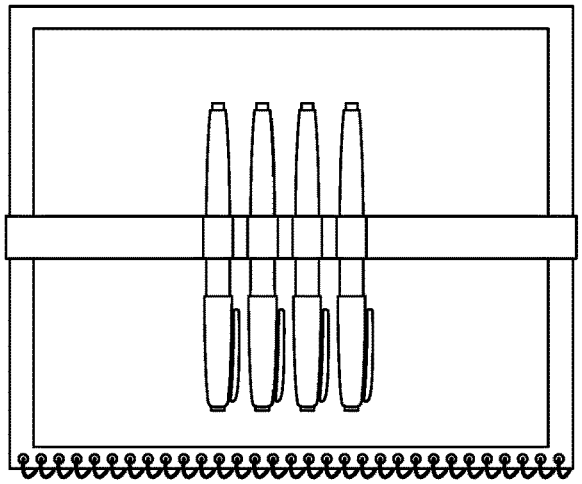
FIG. 1*b* is a front view showing an embodiment of the invention with the journal band in a vertical orientation.

While this invention may be embodied in many forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 1A:
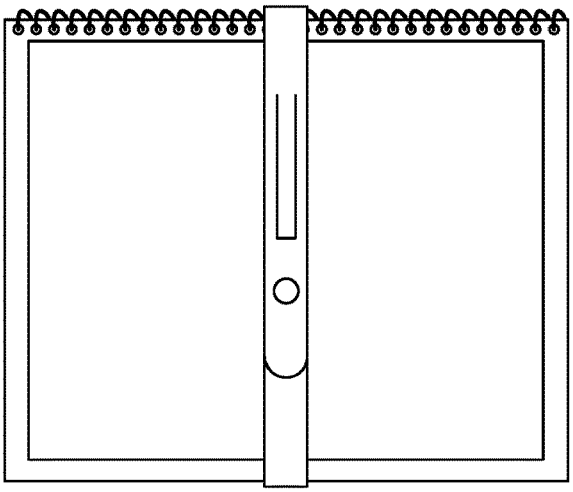
FIG. 1*a* is a back view of the embodiment of FIG. 1.
Figure 1:
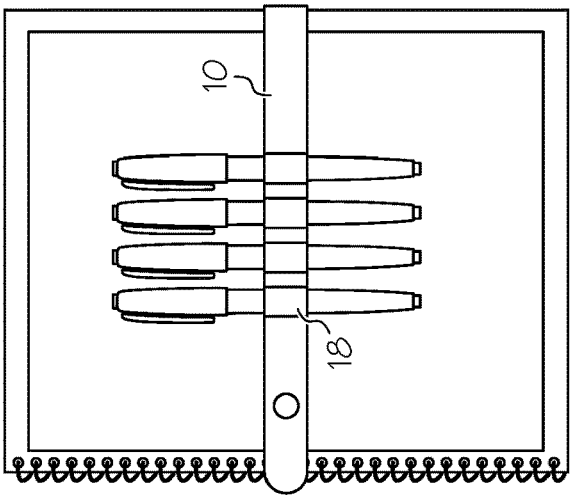
FIG. 1 is a front view showing an embodiment of the invention securing several notebooks and some writing or note taking items.

Referring now to FIGS. 1, 1*a* and 1*b*, the inventive journal band 10 is shown stretched horizontally around several notebooks in FIG. 1, with writing implements in the loops 18. FIG. 1*a* shows the back view, while FIG. 1*b* shows the journal band 10 arranged vertically. The inventive journal band 10 is stretched over individual or multiple stationary items keeping them together and organized such as: tablets, folders, files, papers, books, journals, etc. and provides instrument/pen holders loops.

Figure 2:
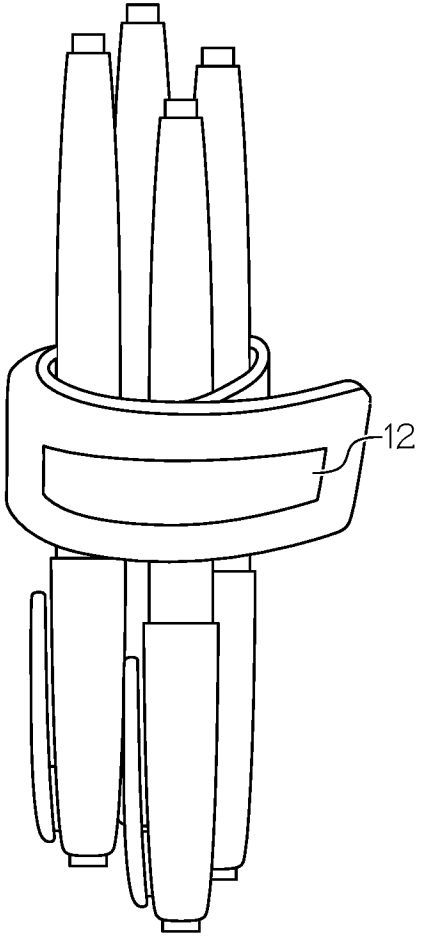
FIG. 2 shows the inventive journal band rolled up and secured to itself to become a compact portable pen/writing implement holder. The band 10 incorporates minimalistic strategically located attachment/closure hardware allowing the band to wrap or fold around itself and secured to itself transform the band into a compact pen holder. Easily packable and ready for service at a moment's notice.

FIG. 2 shows the inventive journal band 10 after it is taken off of the notebooks, and wrapped around and fastened to itself. A label 12 is arranged for easy viewing.

Figure 3:
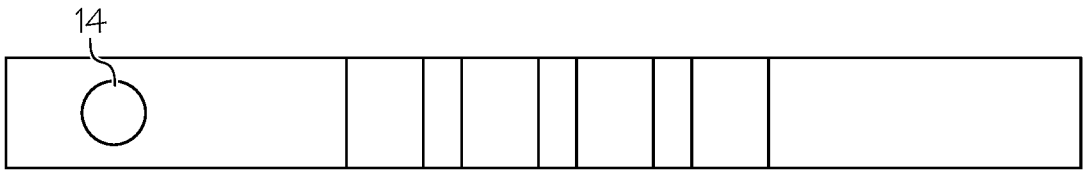
FIG. 3 shows a top view of one half of a snap.

FIG. 3 shows a top view of the band 10 showing the loop holders 18 and male stud snap 14.

Figure 4:
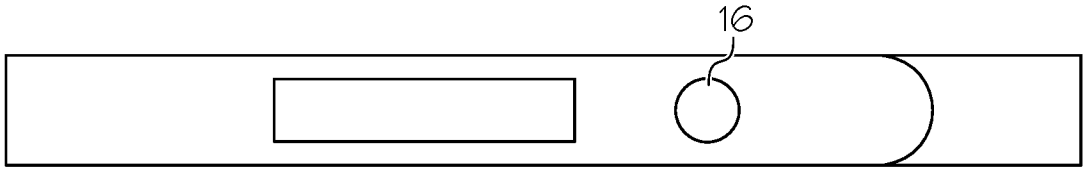
FIG. 4 shows a bottom view of the other half of the snap.

FIG. 4 shows a bottom view of the band 10 with the other half of the female socket snap 16 and label 12.

Figure 5:
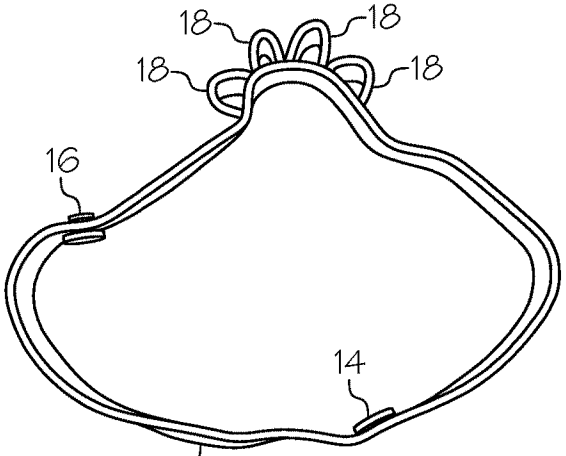
FIG. 5 shows a side view showing both snap portions and the writing implements loops.

FIG. 5 shows a side view of the band 10 showing the elastic loops 18, the label 12 and the two halves of the snap, 14 and 16.

Figure 6:
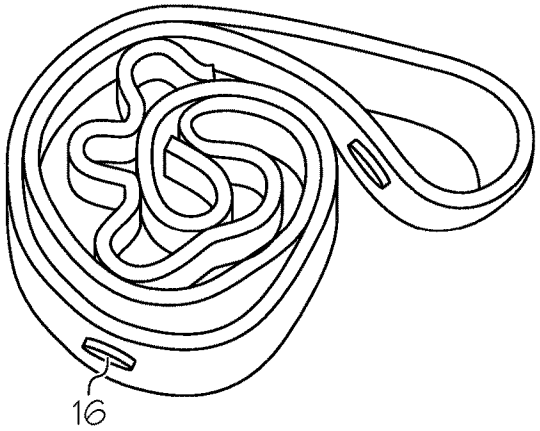
FIG. 6 shows the journal band rolled up and the snap fastened.

FIG. 6 shows the band 10 partially rolled up.

Figure 7:
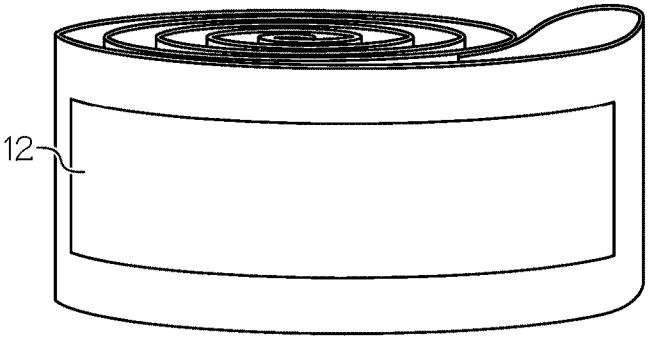
FIG. 7 shows an enlarged view of FIG. 6.

FIG. 7 shows the band 10 rolled up and fastened creating a desk friendly compact pen holder.

Figure 8:
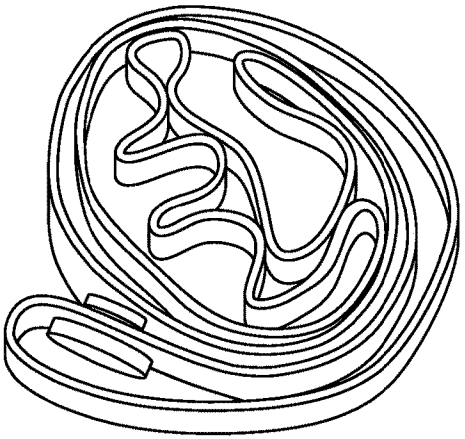
FIG. 8 shows the label.

FIG. 8 shows the label 12, positioned for easy viewing when the band 10 is rolled up and fastened.

Figure 13:
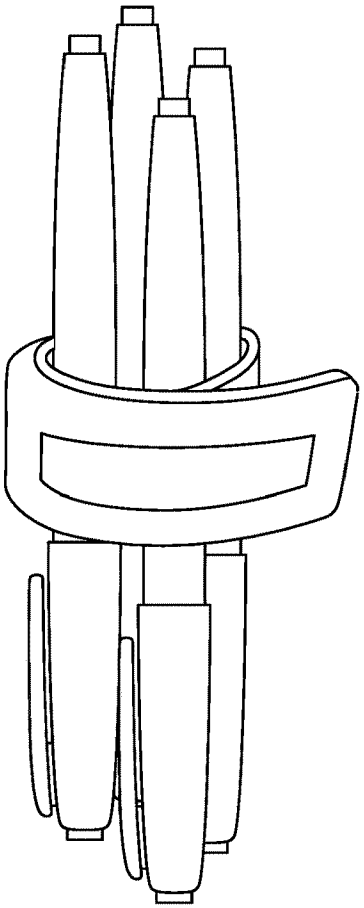
FIG. 13 shows a fully fastened snapped journal band.
Figure 10:
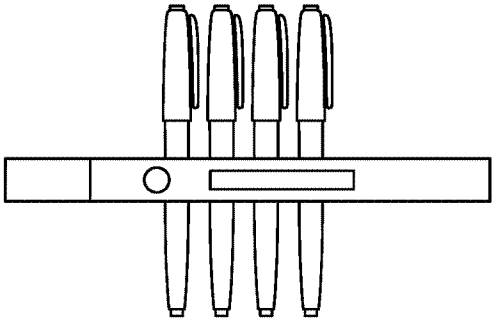
FIG. 10 shows a bottom view FIG. 9.
Figure 12:
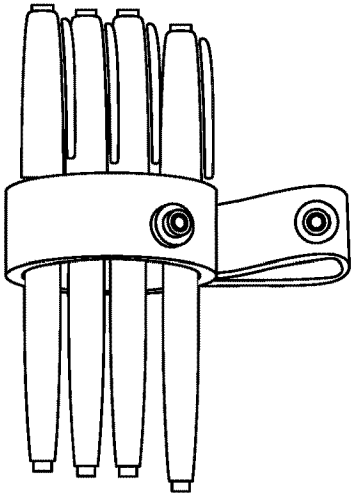
FIG. 12 shows the journal band wrapped around the writing implements just prior to fastening the snap.
Figure 9:
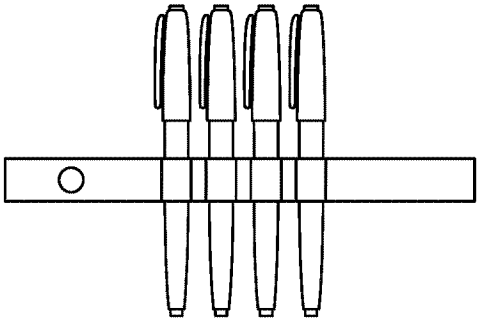
FIG. 9 shows a top view of the journal band with writing implements in the loops 18.
Figure 11:
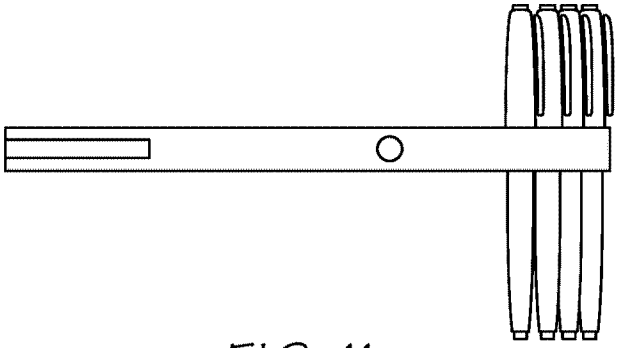
FIG. 11 shows another view of FIG. 9.

Referring now to FIGS. 9-13, the band 10 is shown with a variety of writing implements in loops 18, showing the front view (FIG. 9), the back view (FIG. 10), unrolled view (FIG. 11), partially rolled (FIG. 12) and fully rolled and fastened view (FIG. 13).

Figure 14:
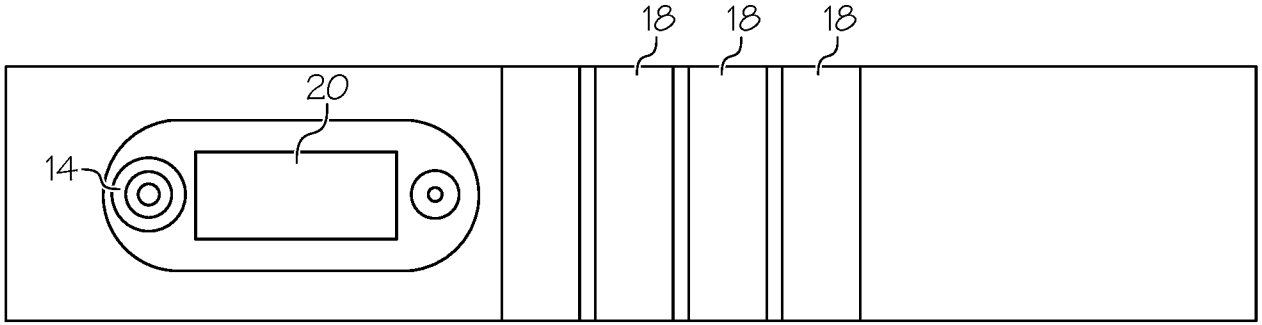
FIG. 14 shows a top view of another embodiment of the inventive journal band with a name plate.
Figure 15:
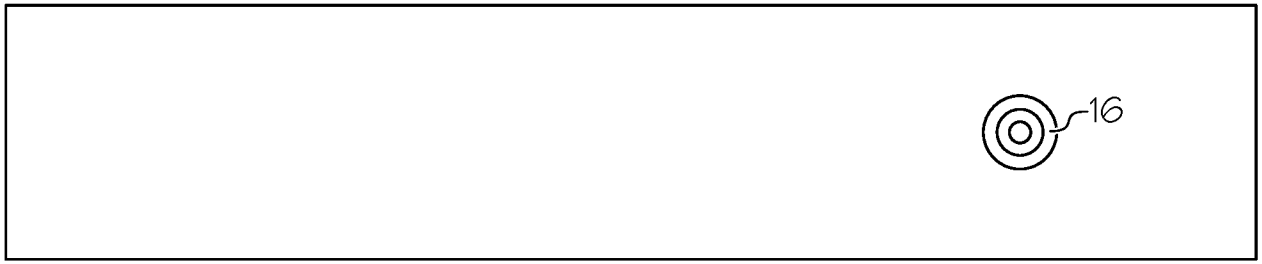
FIG. 15 shows a bottom view of the embodiment of FIG. 14.
Figure 17:
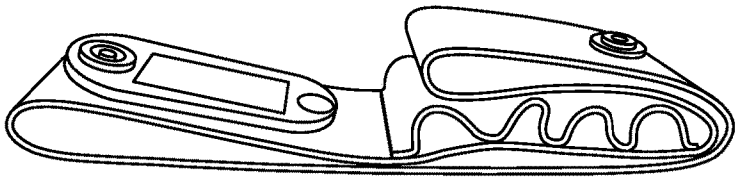
FIG. 17 shows a partially folded view of the embodiment of FIG. 14.
Figure 19:
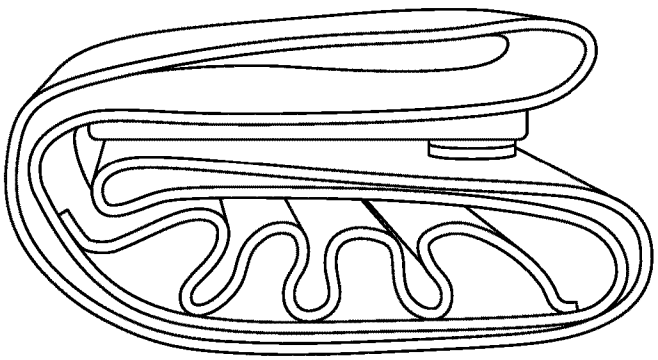
FIG. 19 shows the fully fastened embodiment of FIG. 14.
Figure 16:
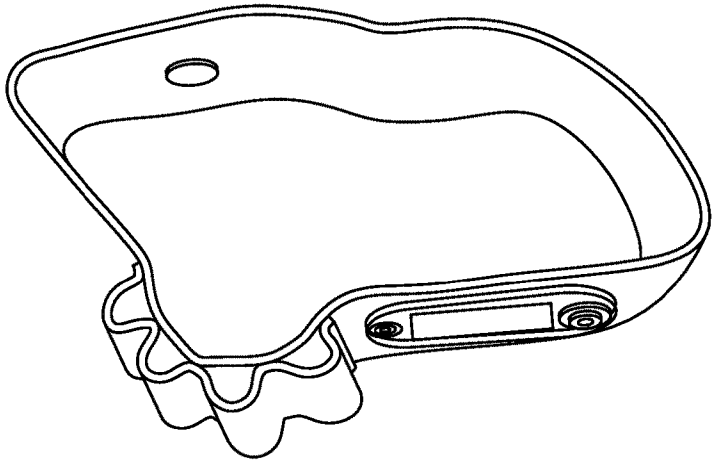
FIG. 16 shows a another view of the embodiment of FIG. 14.
Figure 18:
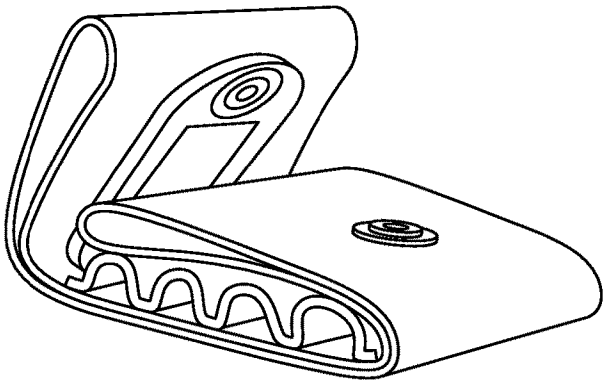
FIG. 18 shows a view of the embodiment of FIG. 14 just prior to snapping.
Figure 20:
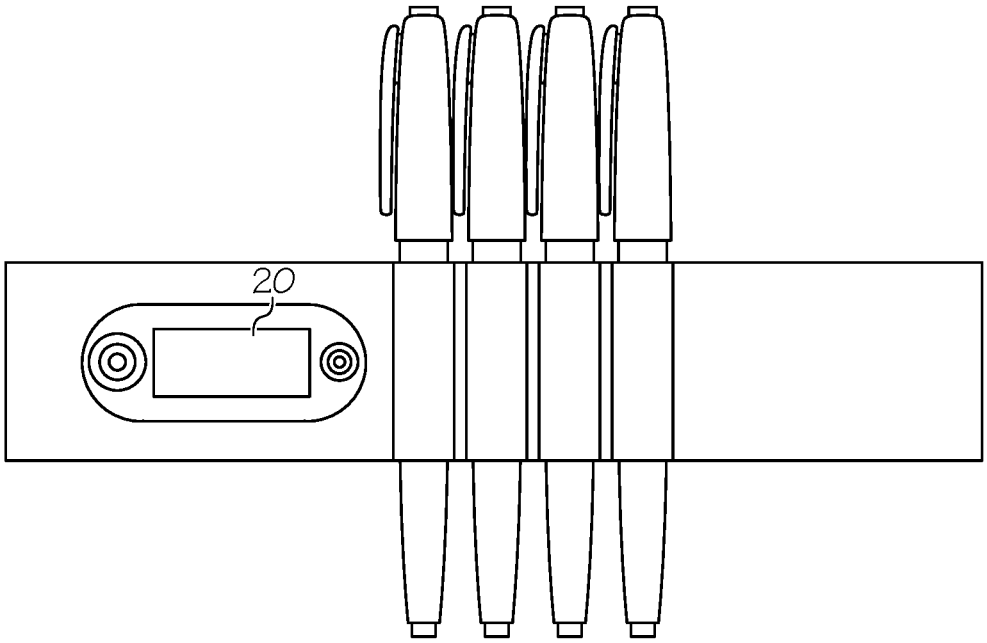
FIG. 20 shows a top view of the FIG. 14 embodiment with writing implements.
Figure 21:
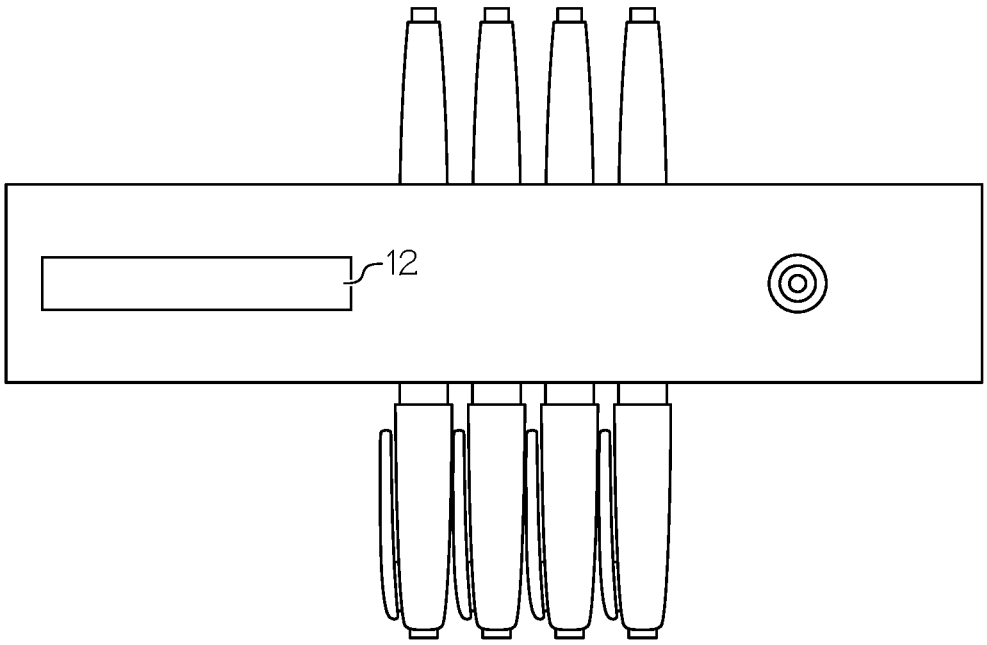
FIG. 21 shows a bottom view of FIG. 20.
Figure 23:
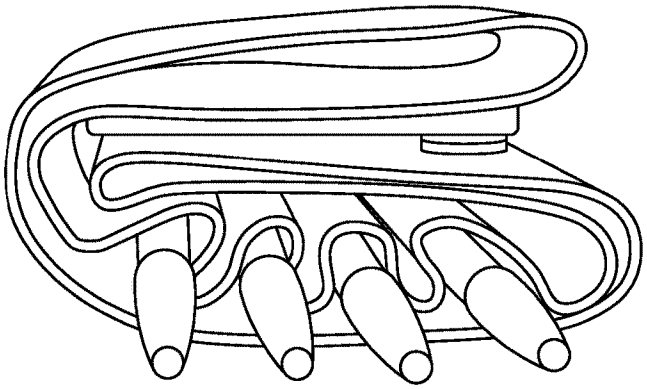
FIG. 23 shows a FIG. 20 just prior to fastening the snap.
Figure 22:
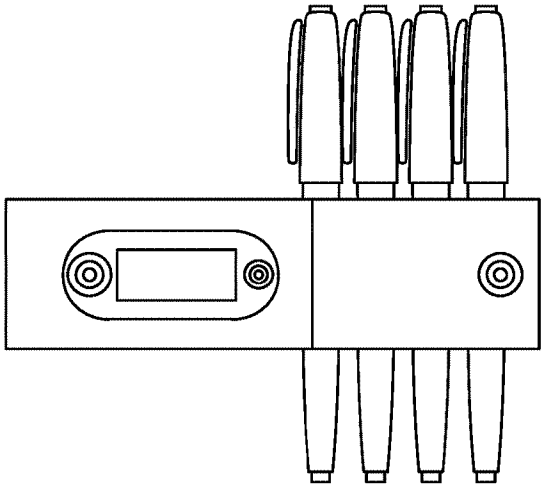
FIG. 22 shows a partially folded view of FIG. 20.
Figure 24:
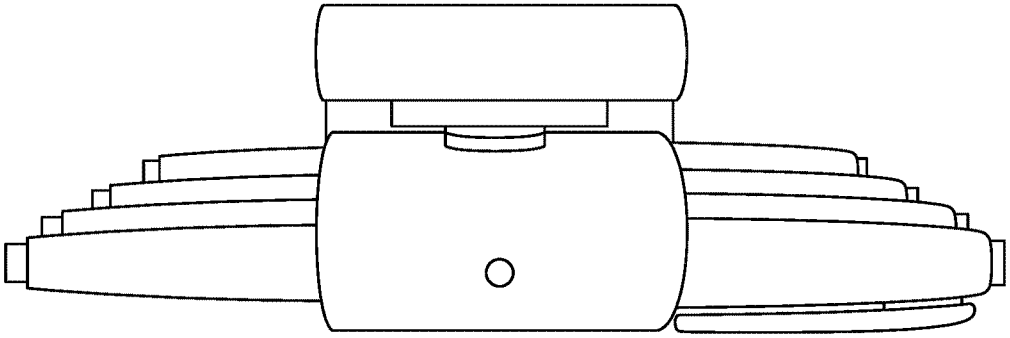
FIG. 24 shows a fully fastened view of FIG. 20.
Figure 26:
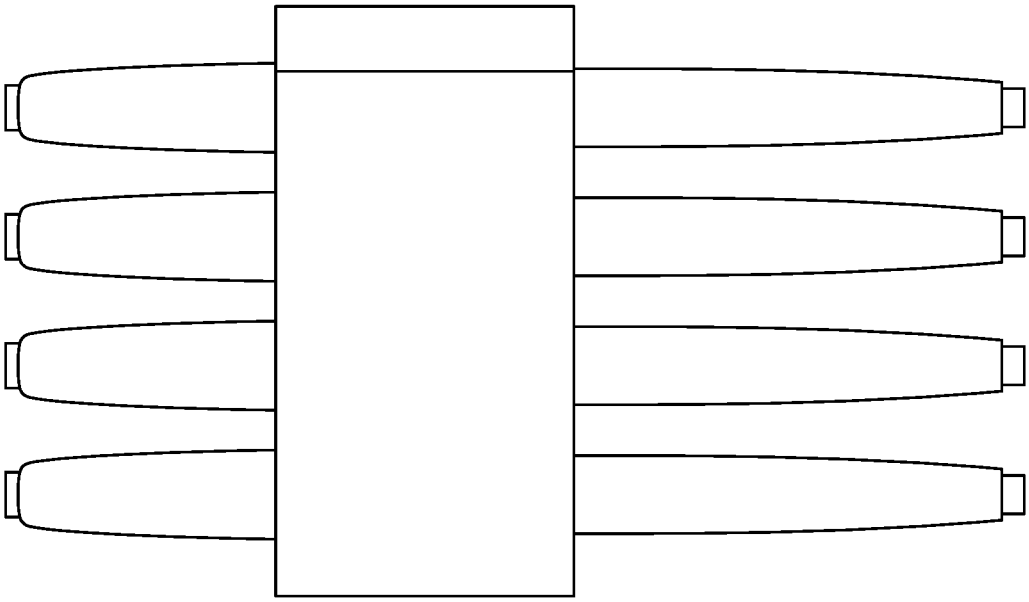
FIG. 26 shows a back view of FIG. 24.
Figure 25:
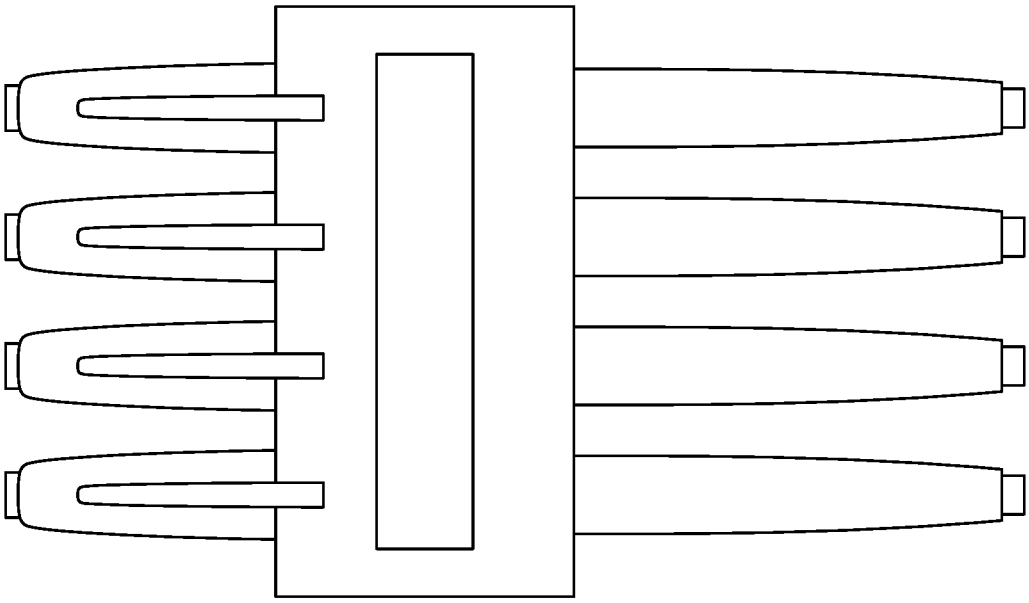
FIG. 25 shows a front view of FIG. 24.
Figure 27A:
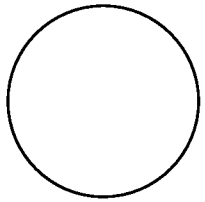
FIG. 27*a*-FIG. 27*h* shows alternative fasteners.
Figure 27B:
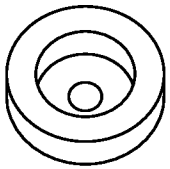
Figure 27C:
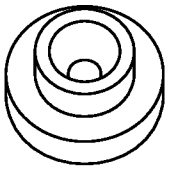
Figure 27D:
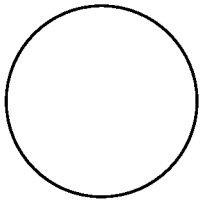
Figure 27E:
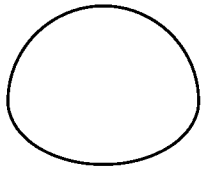
Figure 27F:
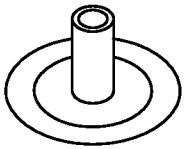
Figure 27G:
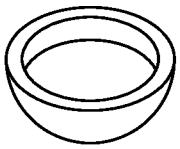
Figure 27H:
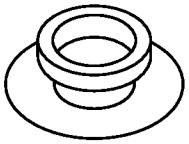

Referring now to FIGS. 14-19, an embodiment is shown with a name tag 20 instead of a label. FIG. 14 is a top view of band 10 showing loop holders 18 and stud snap 14 (left side of personalized name plate). Name plate 20 is an embellishment. The stud 16 in FIG. 15 is in the necessary location for securing after folding. FIG. 16 is a side view of band 10 showing loops 18, and both the stud & socket snaps and the label. FIG. 17 shows band 10 is folded over the loop holders 18 starting from opposite the stud side of band; covering the loop holders and positioning the socket snap over and on top of loop holders. FIG. 18 shows the label side of band can now be folded toward opposite side over the loop holders where it can align with socket snap and secure two together. FIG. 19 shows a side view of band in its folded and snapped state. Same view as FIG. 2 without any instruments in loop holders.

Referring now to FIGS. 20 through 26, the embodiment of FIG. 14 is shown with writing implements in holders 18.

FIG. 27 shows the current method of securing apparatus to itself uses standard KAM snaps. Additional stud and sockets can be added to a variety of misc. embellishment's or tools so they can be easily attached or removed.

Figure 28:
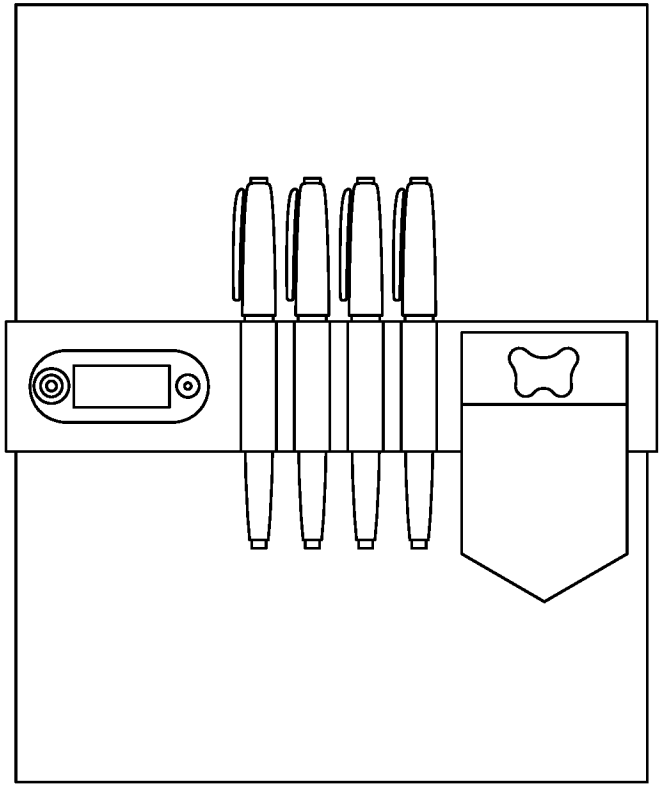
FIG. 28 shows a decorative item fastened to the journal band.

FIG. 28 shows apparatus that has additional embellishments added.

Figure 29:
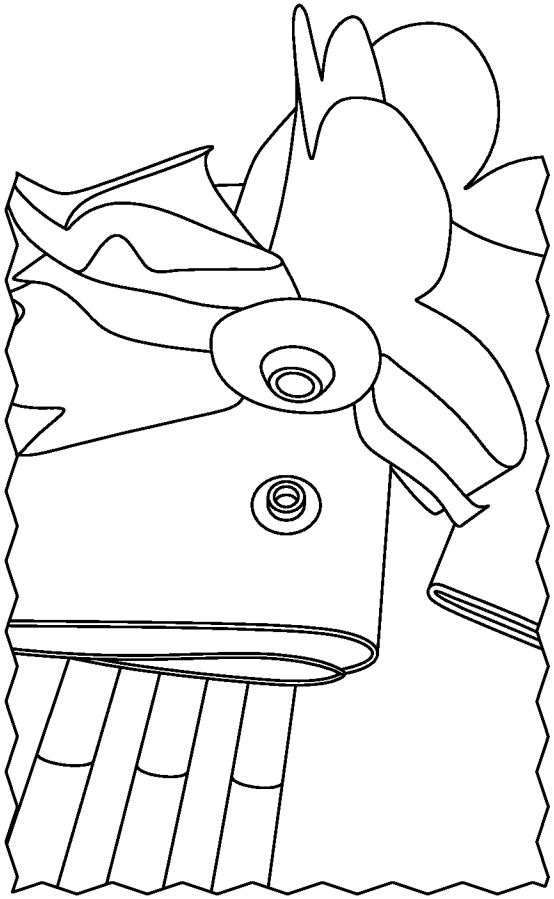
FIG. 29 shows a decorative item just prior to be fastened.

FIG. 29 shows an embellishment with a socket being attached to a stud on apparatus.

Figure 30:
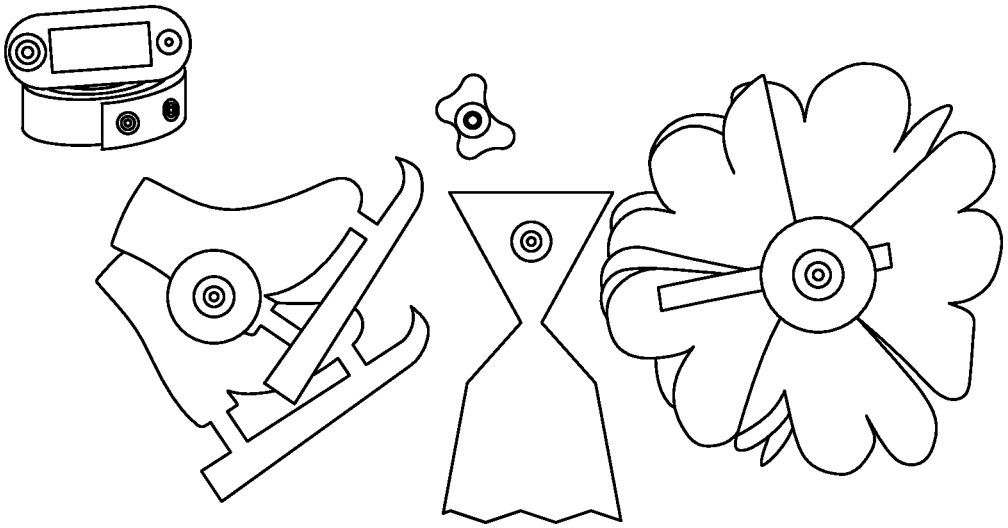
FIG. 30 shows additional decorative items.

FIG. 30 shows a variety of embellishments and their sockets.

Figure 31:
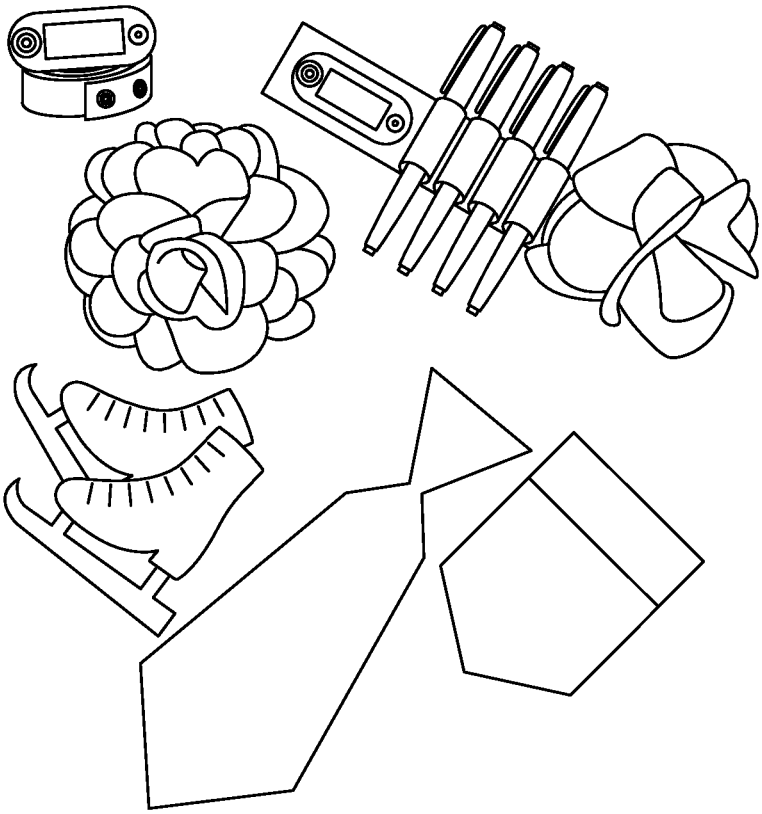
FIG. 31 shows additional decorative items.

FIG. 31 shows a front view of embellishments

Figure 32:
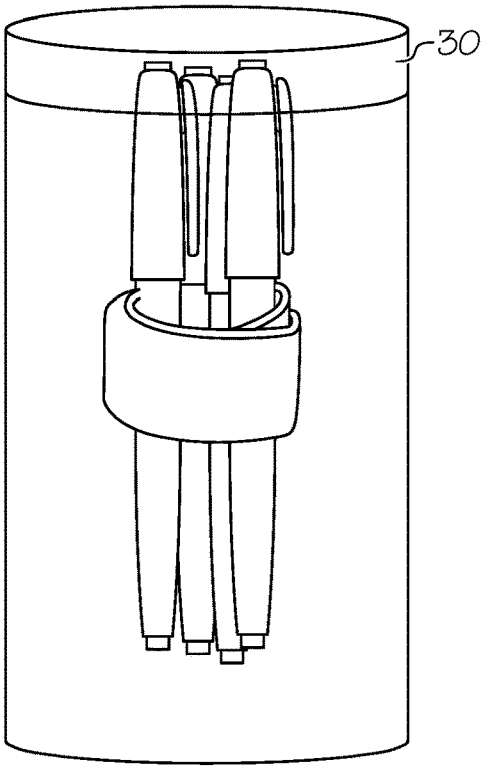

The invention could be sold with writing implements. FIG. 32 shows inventive band 10 and writing instruments prekitted and packaged together in a cylinder shaped translucent container 30. The band 10 is wrapped around writing instruments making the pens and the apparatus viewable in cylinder.

Figure 33:
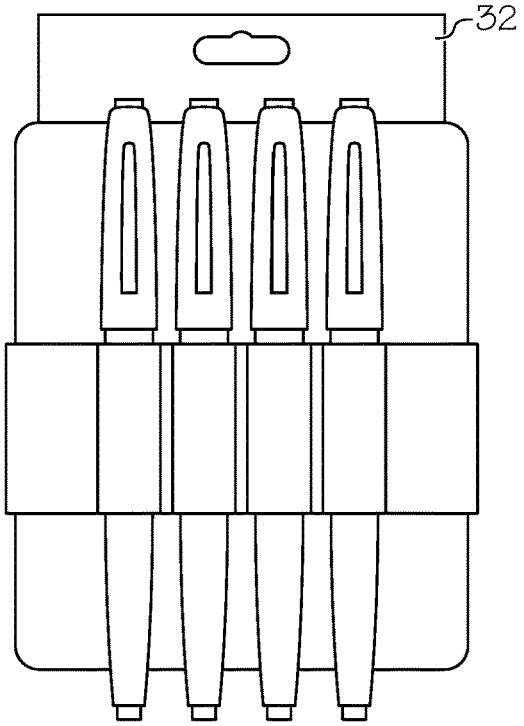
FIG. 33 shows packaging pre-kitted with pens with the journal band partially outside the package.

FIG. 33 shows the band 10 and writing instruments, such as pens, prekitted and packaged together in a clam shell 32. Pens or writing implements are secured behind the clam shell plastic the band 10 is allowed to stick out of the plastic, highlighting it.

A preferred construction method that creates a signature result (the apparatus will have a bowed appearance when not being stretched over something.) Stretch and secure elastic directly under the loop material. Secure the loop material onto the stretched under material vertically every ¾" as marked (see FIG. 35). Note: distance between measurements will vary based on characteristics of elastic being used. When stretched under material is released it will cause the loop material to bow outward creating the loops at consistent and desired width/height. This method can be used with one continuous piece of elastic or multiple material construction as long as the under material that the loop material is attached to is stretchable.

Figure 34:
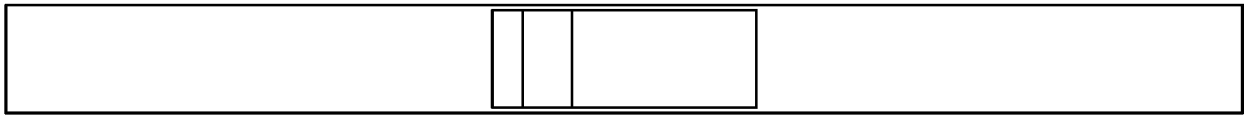
FIG. 34 shows a construction technique where the loop is attached when the base material is in a stretched position, with a different material for the base and loop.

FIG. 34 shows using multiple material construction in this image. The multi colored material is the primary band material. The solid color is for the loops set. The multi colored material in this example is 15" long and the loop material is 5".

Figure 35:
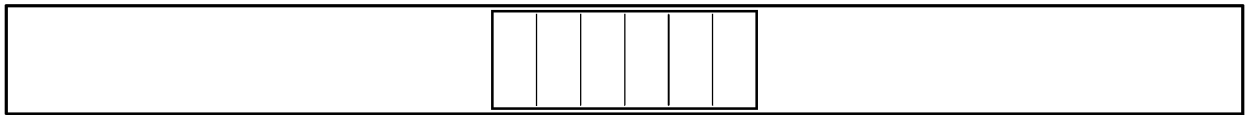
FIG. 35 shows a base material stretched.

FIG. 35 shows that the under material is stretched to near 100% but the loop material is not stretched. At this point the loop material is secured to the under material where marked.

Figure 36:
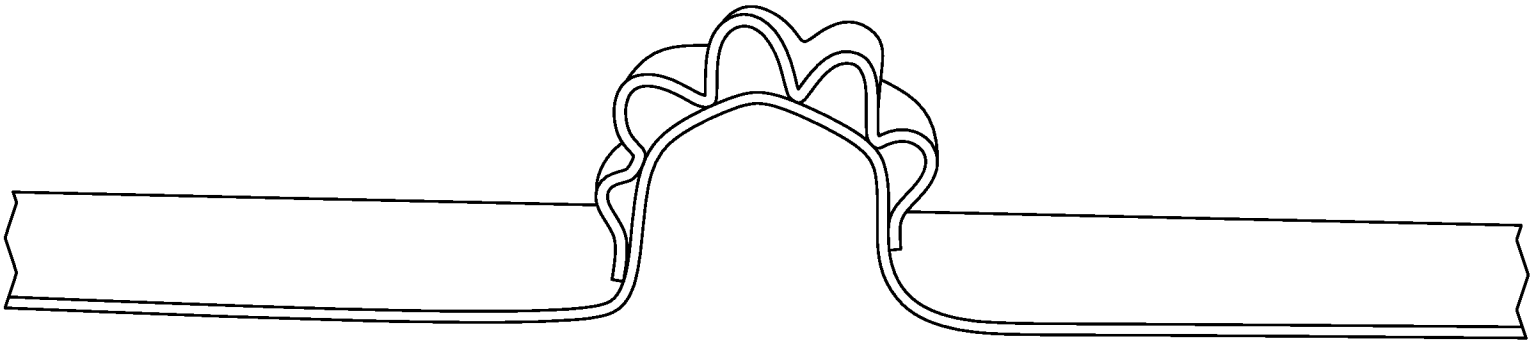
FIG. 36 shows the result, the loops are raised when the journal band is not being stretched.

FIG. 36 shows when under material is released from stretch—the loops are formed in the loop material. And the apparatus has a unique bow shape when not being stretched.

Figure 37:
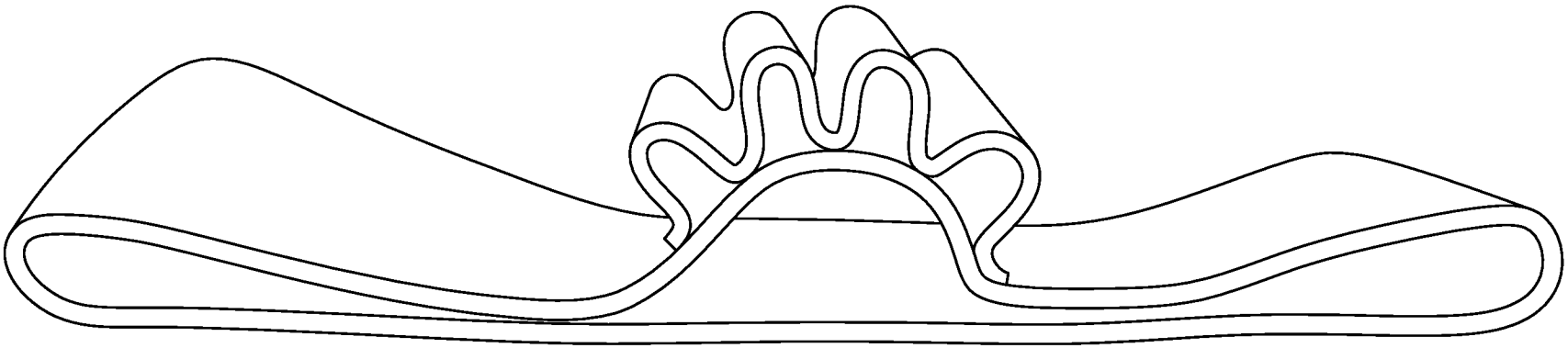
FIG. 37 shows the same base and loop material view of the other half of the snap.

FIG. 37 shows that in this example—one piece of material was used. But above theory of stretching was used to create the loops. Notice the unique resting shape of the apparatus. This shape is indicative of stretching construction method.

Figure 38:
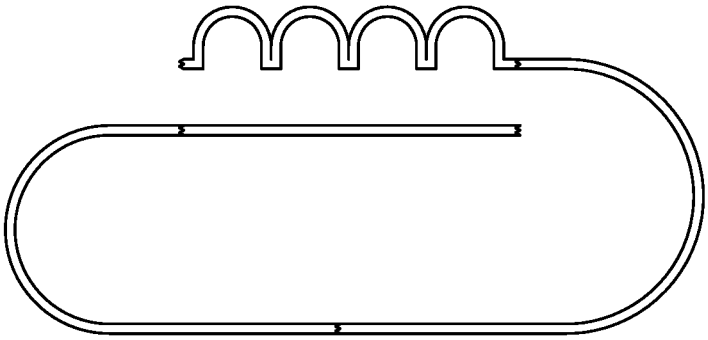
FIG. 38 shows how the inventive journal band can be made of one piece of material.
Figure 39:
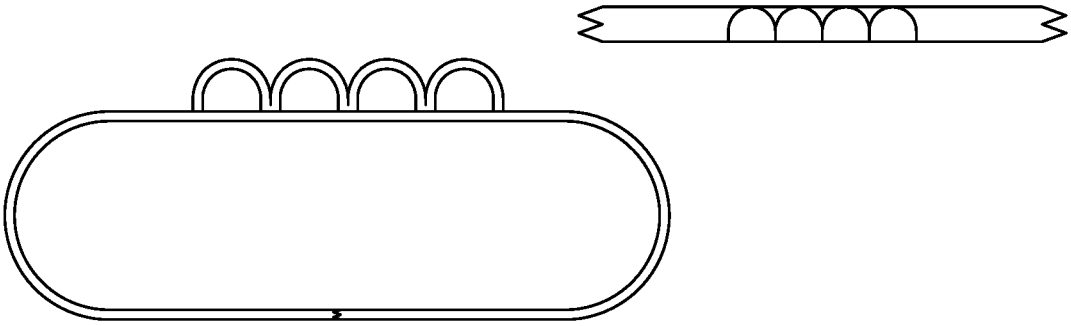
FIG. 39 shows how the inventive journal band can be made of two pieces of material.
Figure 40:
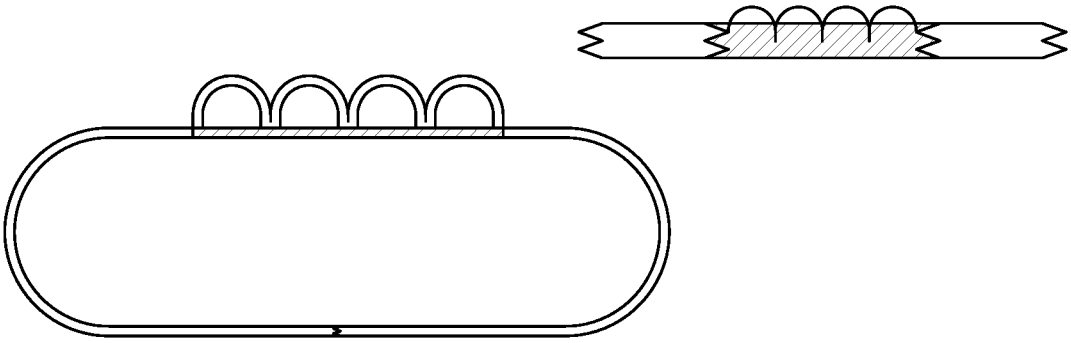
FIG. 40 shows how the inventive journal band can be made of three or more pieces of material.

FIGS. 38-40 show that the inventive band can be made from one piece of material, or two or three or more. The inventive band is made from any commercially available elastic material.

Figure 41:
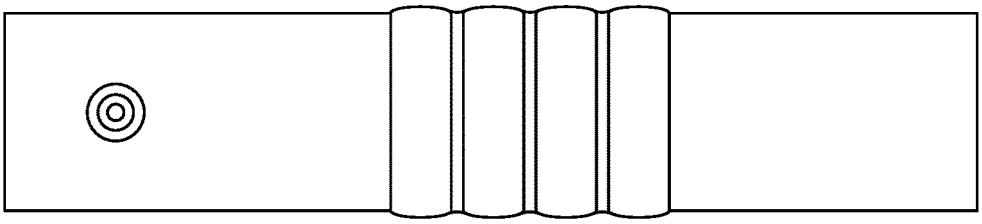
FIG. 41 shows a portion of a metal snap.
Figure 42:
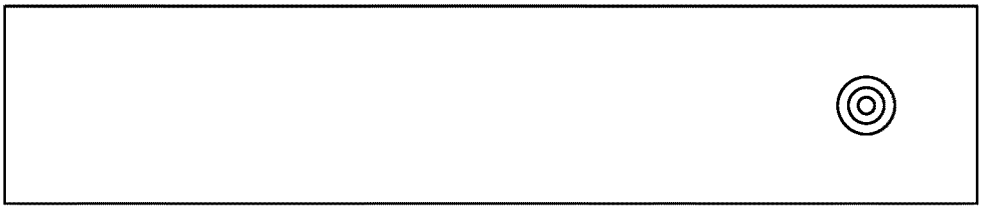
FIG. 42 shows the other half of the metal snap.
Figure 43:
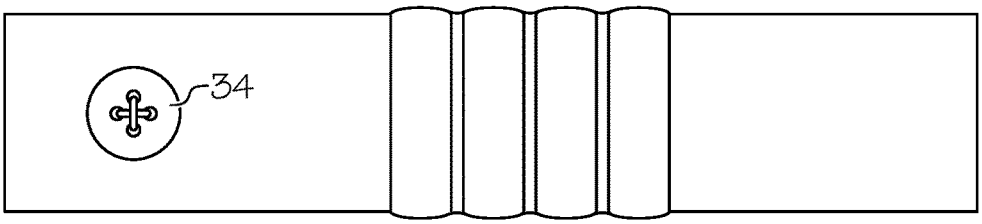
FIG. 43 shows a button fastener.
Figure 44:
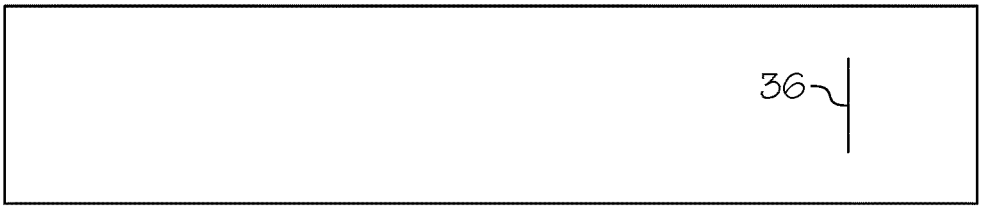

Many variations of closing hardware can be used besides KAM snaps. For example buttons, hook and loop (Velcro), metal snaps, etc. If apparatus is designed to wrap or fold onto itself using a device or some type of hardware, it is intended to fall within the scope of this invention. FIGS. 41 and 42 show metal snaps. FIGS. 43 and 44 show a button 34 and matching button hole 36.

Figure 45:
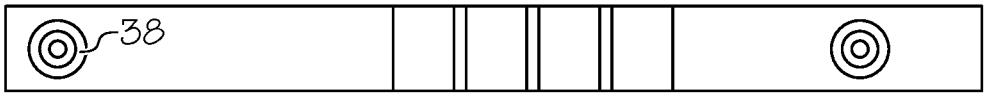
FIG. 45 shows a top view of an embodiment with additional fasteners for embellishments.
Figure 46:
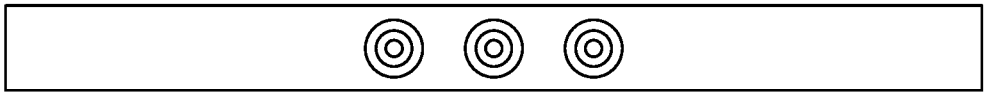
FIG. 46 shows a bottom view of FIG. 45.
Figure 47:
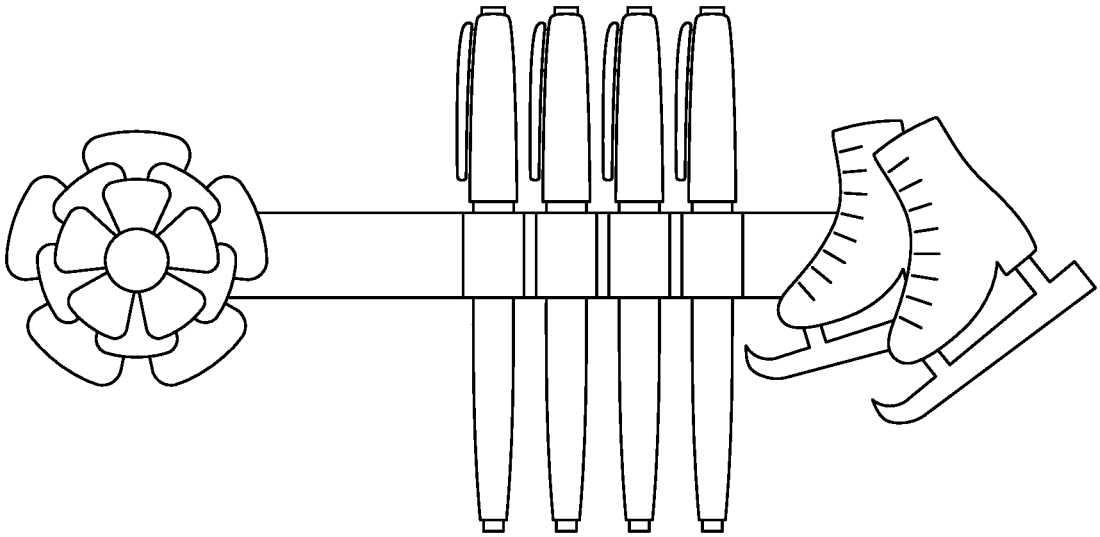
FIG. 47 shows several embellishments attached to the inventive journal band.
Figure 48:
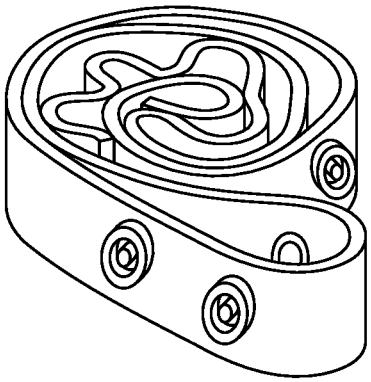
FIG. 48 shows a partially rolled up journal band prior to being fastened to itself.
Figure 49:
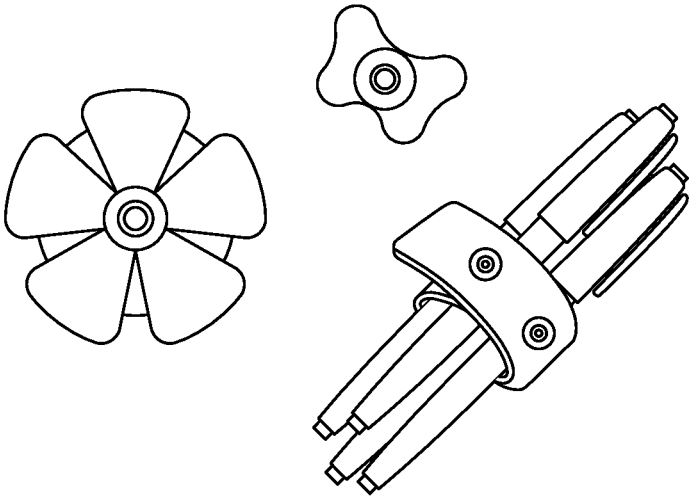
FIG. 49 shows a rolled up journal band with several embellishments which can be fastened to decorate the band.
Figure 50:
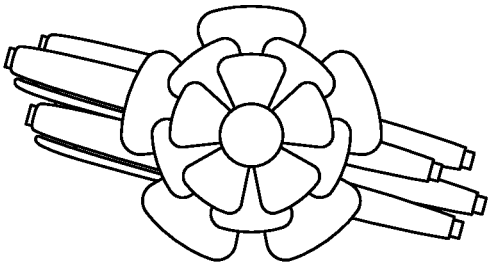
FIG. 50 shows FIG. 49 with an embellishment attached.

Attachable and removable embellishments and/or tools may also use other types of hardware besides those disclosed as examples herein. They too are intended to fall within the scope of the invention. FIG. 45 shows a top view of an additional snap 38 for attaching an embellishment. FIG. 46 shows the bottom view. FIG. 47 shows two embellishments attached to the band 10. FIG. 48 shows the partially rolled up band 10. FIG. 49 shows the fully rolled band with snap 38 ready for attaching an embellishment. FIG. 50 shows the embellishment attached to the snap 38.

Additional hardware can be added to accommodate multiple closing and attachability at various locations depending on desired effect or needs.

Figure 51:
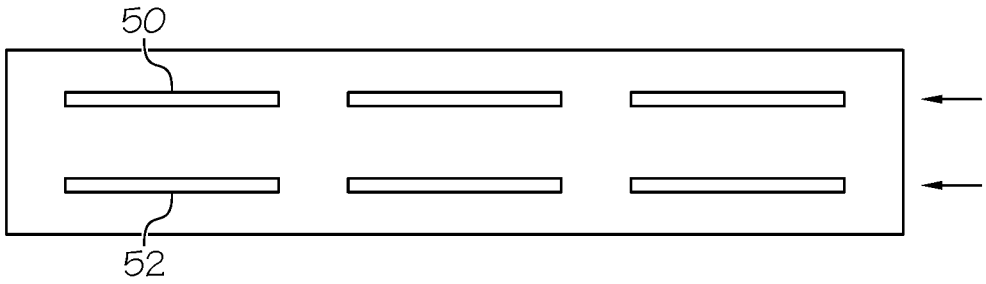
FIG. 51 shows an alternate embodiment with an elastic loop made from two custom woven holes/slits.
Figure 52:
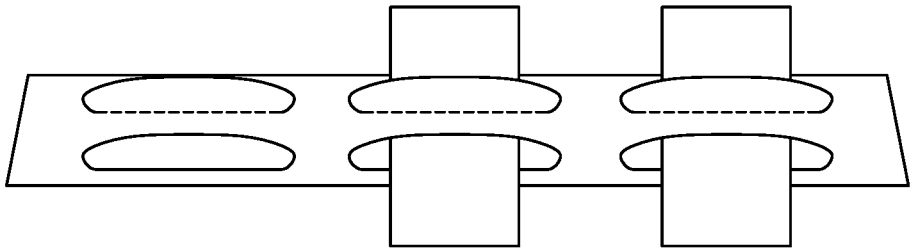
FIG. 52 shows the embodiment of FIG. 51 with a writing implement inserted into two of the loops.
Figure 53:
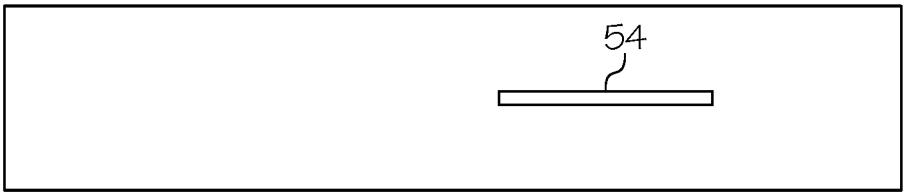
FIG. 53 shows a larger custom woven hole/slit, sized to hold other miscellaneous tools, and designed to be used with a cell phone or tablet finger or holder.
Figure 54:
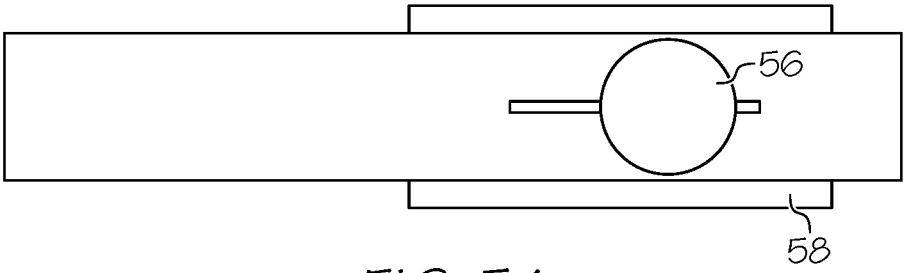
FIG. 54 shows FIG. 53 with a cell phone with a holder button inserted through the custom woven slit.
Figure 55:
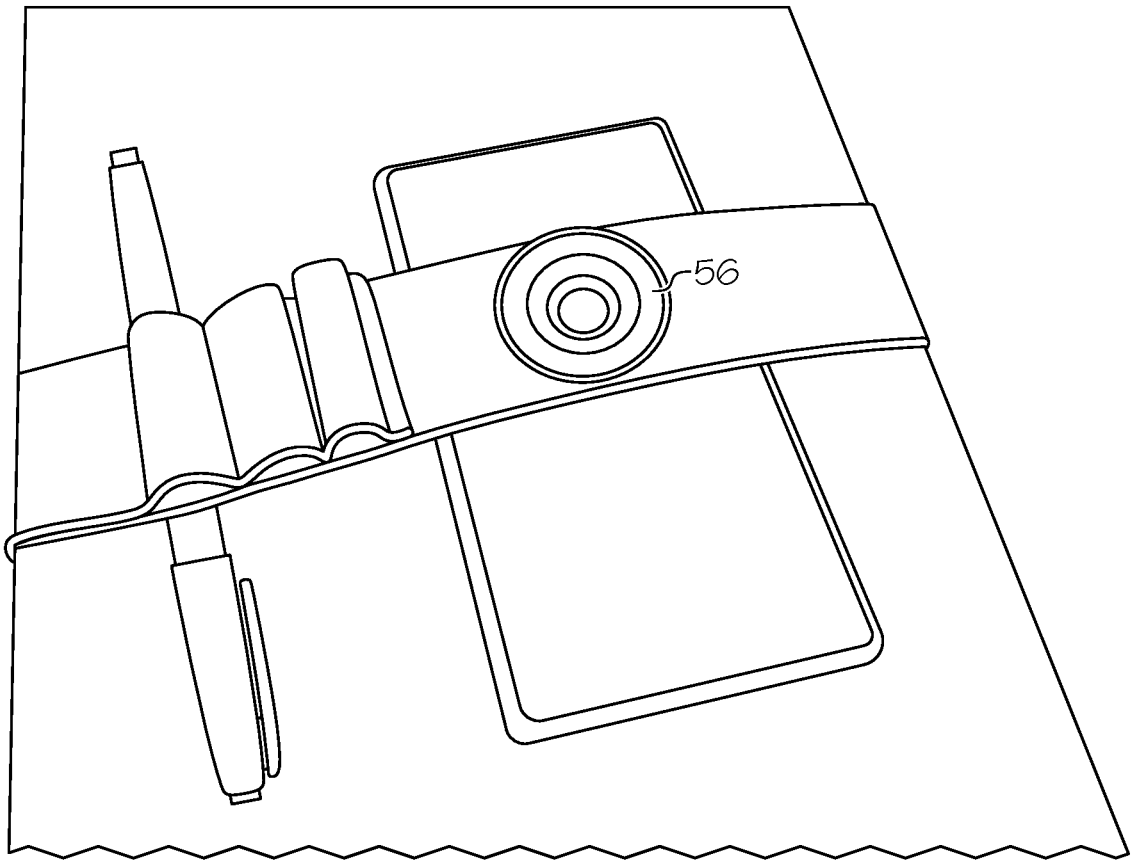
FIG. 55 shows a cellphone with a holder inserted through a slit in the band.
Figure 56:
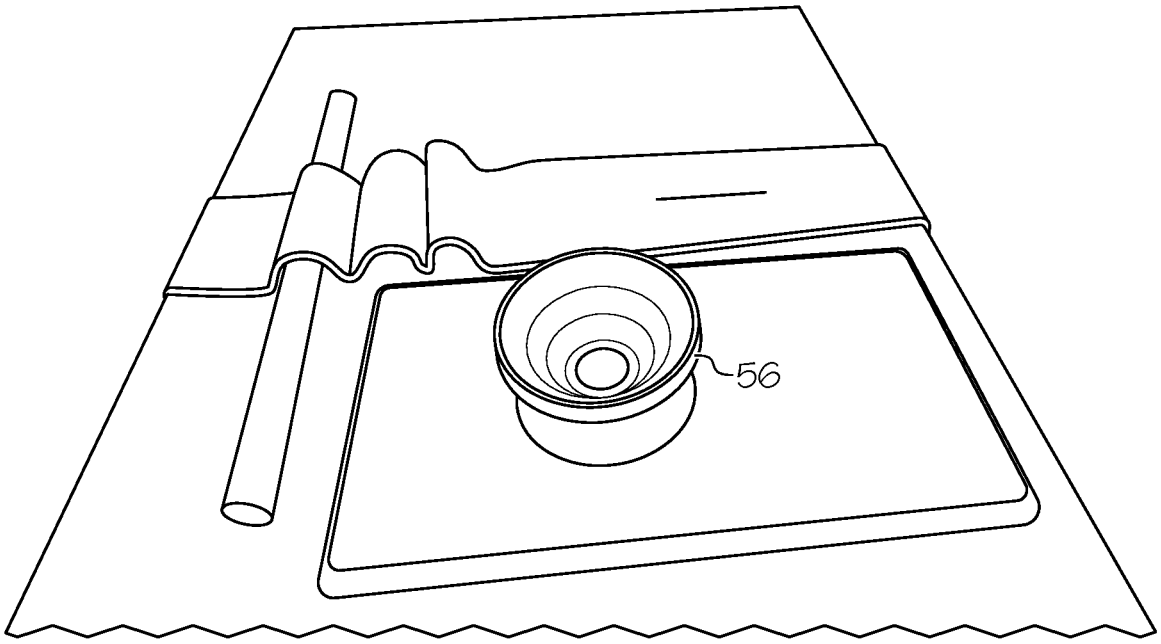
FIG. 56 shows a close-up of the commercially available holder on the cellphone.

Referring now to FIGS. 51-56, another embodiment is shown in which the elastic loop is formed of two slits, 50 and 52, spaced apart, as shown in FIG. 51. The slits are preferably made with a custom weave pattern with the slits built in. The slits could also be cut and finished like a buttonhole. The slits could also be made with two pieces sewn together, leaving space for the slit, or three pieces for the two spaced apart slits. FIG. 52 shows the elastic loops formed from the two spaced apart slits 50 and 52 of FIG. 51 with a writing utensil inserted into two of the elastic loops. FIG. 53 shows an embodiment with a single slit 54, which can be used, for example, to hold a mobile device such as a smartphone or tablet, as shown in FIG. 54 at 58. FIG. 55 show a smartphone with a holder 56 inserted through the slit 54. FIG. 56 shows a close-up of the holder 56 which can be inserted through slit 54.

What is claimed is:

1. An elastic band, comprising:

a band, at least a portion of which is elastic;

a loop formed from two woven slits made in the elastic band to form the loop to hold an object, and further including a male snap portion and a female snap portion attached to the band, configured and arranged so that when the band is not in use securing the object, it can be folded or rolled up and the male snap portion and the female snap portion can be snapped together.

2. The elastic band of claim 1 wherein the object is a writing implement.

3. The elastic band of claim 1 wherein the object being held is a mobile device, with a holder which is inserted through the slit of the elastic band.

4. An elastic band, comprising:

a band, at least a portion of which is elastic;

a woven slit made in the elastic band to hold an object, and further including a male snap portion and a female snap portion attached to the band, configured and arranged so that when the band is not in use securing the object, it can be folded or rolled up and the male snap portion and the female snap portion can be snapped together.

* * * * *